United States Patent [19]

Evans et al.

[11] Patent Number: 4,683,700

[45] Date of Patent: Aug. 4, 1987

[54] CUT-OFF MECHANISM FOR CLIP ATTACHMENT APPARATUS

[75] Inventors: Alfred J. Evans; Francis E. Sarginger, both of Raleigh, N.C.

[73] Assignee: Tipper Tie, Inc., Apex, N.C.

[21] Appl. No.: 734,337

[22] Filed: May 14, 1985

[51] Int. Cl.[4] ..... B65B 9/08

[52] U.S. Cl. ..... 53/138 R; 53/379; 53/138 A; 83/171

[58] Field of Search ..... 29/243.56, 564.7; 83/171; 53/138 R, 138 A, 379, 550

[56] References Cited

U.S. PATENT DOCUMENTS

| | | | |
|---|---|---|---|
| Re. 30,196 | 1/1980 | Velarde | 53/138 A |
| 2,880,419 | 4/1959 | Tipper | 53/138 A |
| 3,050,916 | 8/1962 | Gausman et al. | 53/379 |
| 3,157,553 | 11/1964 | Spallina | 83/171 |
| 3,394,528 | 7/1968 | Tipper | 53/512 |
| 3,543,378 | 12/1970 | Klenz | 29/243.57 |
| 3,587,204 | 6/1971 | George | 53/138 A |
| 4,001,926 | 1/1977 | Velarde | 29/243.56 |
| 4,215,607 | 8/1980 | Hudson et al. | 83/171 |
| 4,223,508 | 9/1980 | Wells | 53/138 A |

FOREIGN PATENT DOCUMENTS

| | | | |
|---|---|---|---|
| 2318388 | 10/1974 | Fed. Rep. of Germany | 83/171 |
| 2134321 | 12/1972 | France | 83/171 |
| 1438628 | 6/1976 | United Kingdom | 83/171 |
| 291466 | 3/1971 | U.S.S.R. | 83/171 |

*Primary Examiner*—Horace M. Culver
*Assistant Examiner*—Daniel W. Howell
*Attorney, Agent, or Firm*—Allegretti, Newitt, Witcoff & McAndrews, Ltd.

[57] ABSTRACT

An improved double clipper utilizes a heated bar to sever elastic netting material which has been clipped.

4 Claims, 5 Drawing Figures

CUT-OFF MECHANISM FOR CLIP ATTACHMENT APPARATUS

BACKGROUND OF THE INVENTION

This invention relates to an improved clip attachment apparatus and more particularly to a double clipper which includes a cut-off knife construction particularly useful for cutting plastic netting material.

Heretofore various patents have disclosed apparatus known as clippers. Clippers are generally defined as apparatus for attaching a U-shaped, metal clip about gathered material such as food casing. The clip is generally driven by a punch which cooperates with a die to form the clip about the gathered material. Various prior art patents disclosing such mechanisms include Tipper, U.S. Pat. Nos. 3,394,528, 3,543,378, and 2,880,419. Other patents disclosing a mechanism of this type are Velarde, U.S. Pat. Nos. Re. 30,196 and 4,001,926.

Often a pair of clippers are arranged side by side to simultaneously attach two spaced clips to netting or wrapping material. The two clips are spaced about one-half to one inch apart. One of the clips closes off or seals material which has been packaged. The second clip will define the first end of a package which is to be filled. Velarde in U.S. Pat. No. 4,001,926 discloses such a construction. Typically, after the two spaced clips are attached to the gathered material, the material between the clips is cut. A cutting knife such as shown in U.S. Pat. No. Re. 30,196 may be used to effect the cutting of the gathered material.

While such a cutting knife has worked well, the use of such a cutting knife to cut plastic netting material has not been as effective as desired. That is, plastic netting material, when cut with such a knife, may tend to produce plastic shards or plastic fragments of netting material that can potentially contaminate the product being processed by the equipment. As a result, a new and more effective method of cutting or shearing such netting in a manner which produces no fragments is deemed desirable.

SUMMARY OF THE INVENTION

Briefly, the present invention comprises the improvement in a clip attachment apparatus of an improved cutting mechanism particularly useful for cutting or shearing plastic or elastic netting material. The improved, new cut-off mechanism comprises a fixed pad which cooperates with a movable, heated shearing knife or bar. The pad is positioned adjacent the material which is to be severed. The movable cutting bar, which is heated, is mounted on a support so that it can be translated between a position which will engage and shear the netting material and a retracted position. Preferably the cutting bar has a wedge-shaped cross section which tends to increase the tension upon the netting material as the wedge-shaped member cuts of melts through the netting material. The heated cutting bar also fuses the cut ends of the netting material thereby eliminating the formation of any fragments of material during the cutting operation.

Thus, it is an object of the present invention to provide an improved clipper apparatus which includes means for cutting plastic netting material.

Still a further object of the present invention is to provide an improved double clipper apparatus which incorporates a unique cut-off mechanism for severing plastic netting material that is clipped by the double clipper mechanism.

One further object of the present invention is to provide an improved cut-off mechanism for use on plastic netting material and which effectively eliminates the formation of fragments of material during the cutting operation.

Another object of the invention is to provide an improved, mechanically reliable and easily adjustable cutting mechanism for use with a clipper apparatus.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
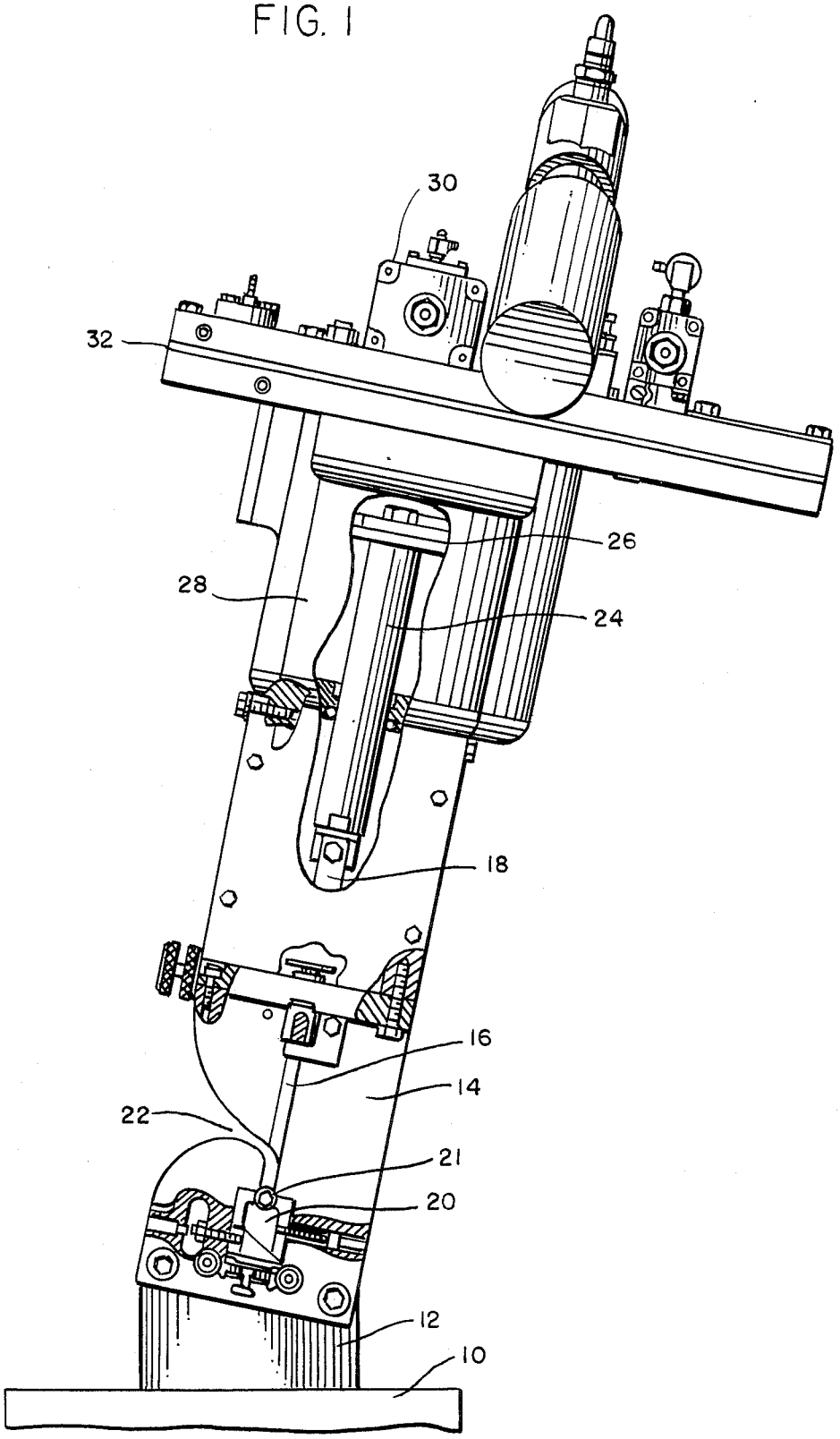
FIG. 1 is a side elevation of a typical double clipper which incorporates the improved cut-off mechanism of the present invention.
Figure 2:
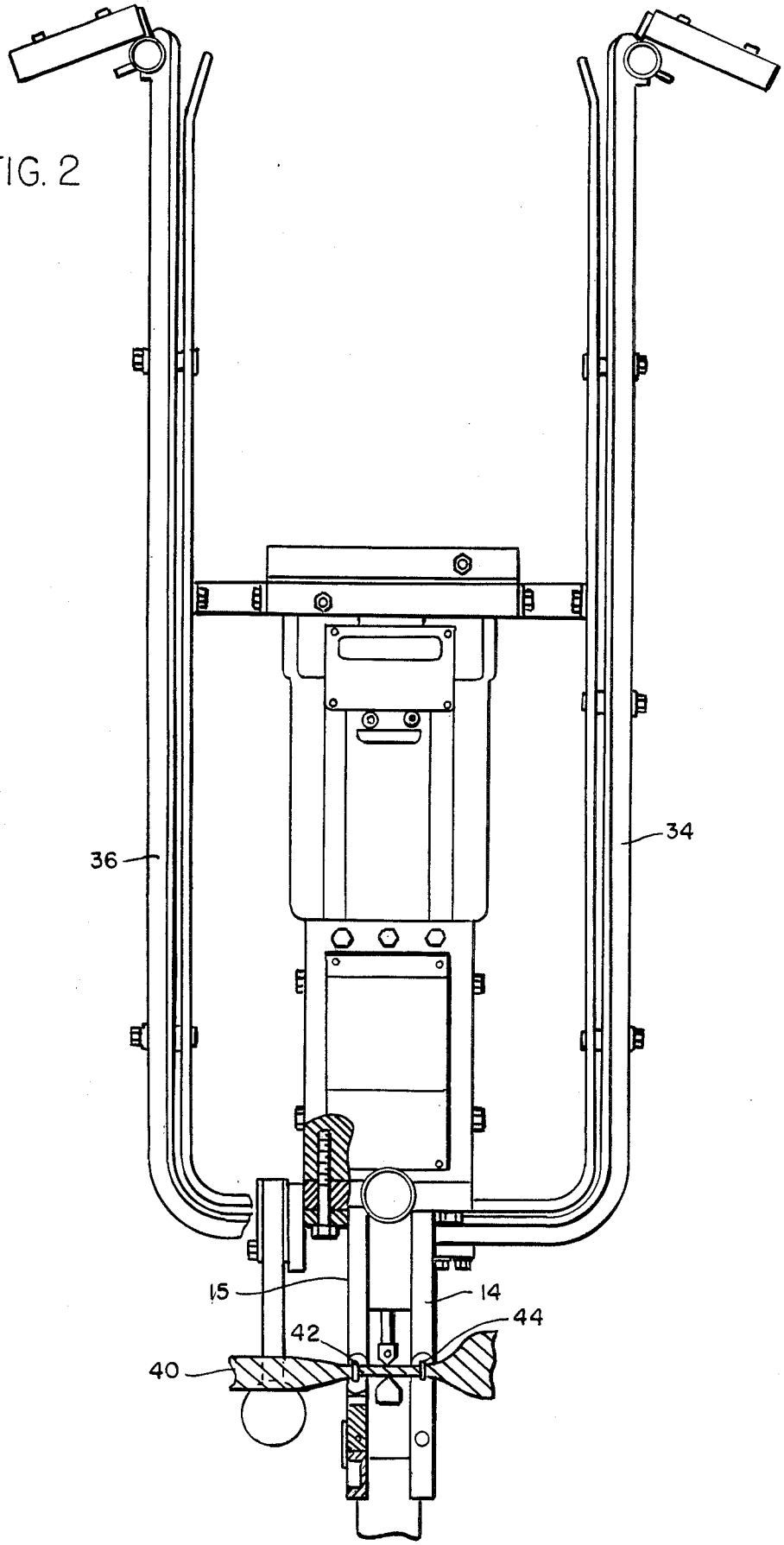
FIG. 2 is a front elevation of a typical double clipper of the type shown in FIG. 1.

FIGS. 1 and 2 illustrate a typical double clipper. Such a clipper includes a base plate 10 with a vertical support member 12 upon which the clipper is mounted. The vertical support member 12 suspends or supports parallel, spaced C-shaped plates 14, 15 associated with the clipper mechanism. Plates 14, 15 each include a clip channel 16 through which a U-shaped metal clip may be moved by means of a punch 18 into engagement with a die 20 to form the clip about gathered material (21 in FIG. 3). Thus, material such as a sheared casing material or a plastic netting may be inserted through a throat opening (22 in plate 14, 23 in plate 15) and positioned over the die 20. Each punch 18 is then driven by a drive rod 24 to translate a clip down the associated clip channel into engagement with the associated die 20 for forming about gathered material 21. The drive rod 24 is driven by means of a piston 26 mounted in a cylinder 28. The piston 26 is pneumatically operated in response to a control mechanism 30 mounted on a cylinder head plate 32.

In the double clipper illustrated in FIGS. 1 and 2, first and second clip support rails 34 and 36 are arranged on opposite sides of the cylinder 28. The cylinder 28 thus provides a single drive rod 24 which actuates a pair of parallel punches 18 to engage clips discharged from the rails 34 and 36 and drive those clips about gathered material. For example, referring to FIG. 2, plastic netting 40 is positioned in the throat openings 22, 23 and first and second clips 42 and 44 are placed about the netting 40. The clips 42 and 44 are appropriately spaced from one another so that the improved cutting mechanism of the present invention may operate to sever the gathered material 40 between the clips 40 and 42. The present invention thus relates particularly to the construction of the cut-off mechanism.

Figure 3:
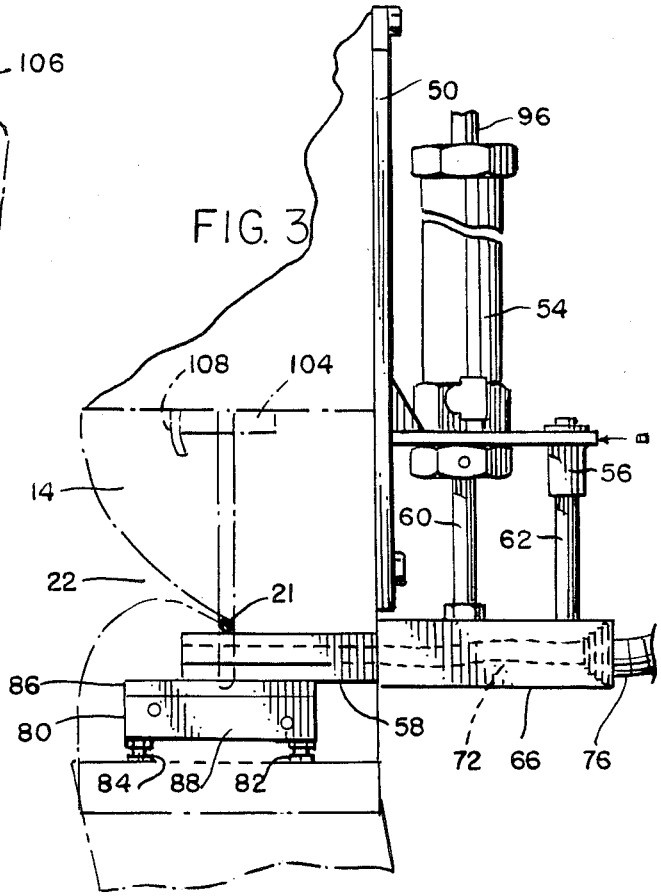
FIG. 3 is a partial side elevation of the cut of mechanism.

Referring therefore the FIG. 3, a side elevation illustrates the improved cut-off mechanism of the present invention. The mechanism includes an attachment support plate 50 which is attached to the side of the clipper. A cylinder support bracket 52 projects laterally from plate 50. A double acting drive cylinder 54 is attached to the bracket 52. A guide bushing 56 is provided in the end of the bracket 52.

A cutting bar 58 is attached to a drive rod 60 of the cylinder 54. The cutting bar 58 is thus movable in response to movement of the rod 60. A guide rod 62 is affixed to the cutting bar 58 extends through the guide bushing 56 to maintain the cutting bar 58 in proper alignment as it is moved by operation of rod 60. The cutting bar 58 includes a wedge-shaped cutter member 64 and a rear mounting block 66. A cylindrical throughbore 68 is provided in the cutting bar 58. A heating element or heating bar 72 is positioned within the throughbore 68. The actual heating element 72 extends over the cutting portion or wedge member 64 of the cutting bar 58. Power leads 76 connect the heating element 72 to a power source.

Figure 5:
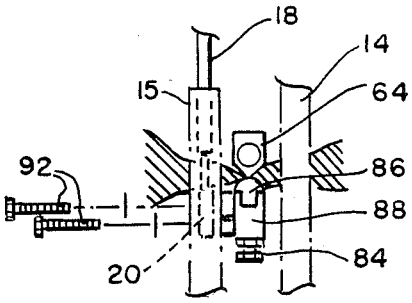
FIG. 5 is a partial front elevation illustrating the cut-off mechanism of the present invention.

As shown in FIG. 3, the wedge member 64 defines an edge in opposed relation to a cutting block 80 which is mounted in the space between plates 14 and 15. Block 80 is mounted on adjustable support pins 82 and 84. The cutting block 80 preferably includes a silicon pad 86 mounted in a metal support member 88. The pad 86 has a generally semi-cylindrical configuration as illustrated in FIG. 5. The mid-line of the cylindrical surface of the pad 86 aligns with the edge of the wedge member 64, again as shown in FIG. 5. The block 80 is also maintained in position by transverse bolts 92 as shown in FIG. 5.

Figure 4:
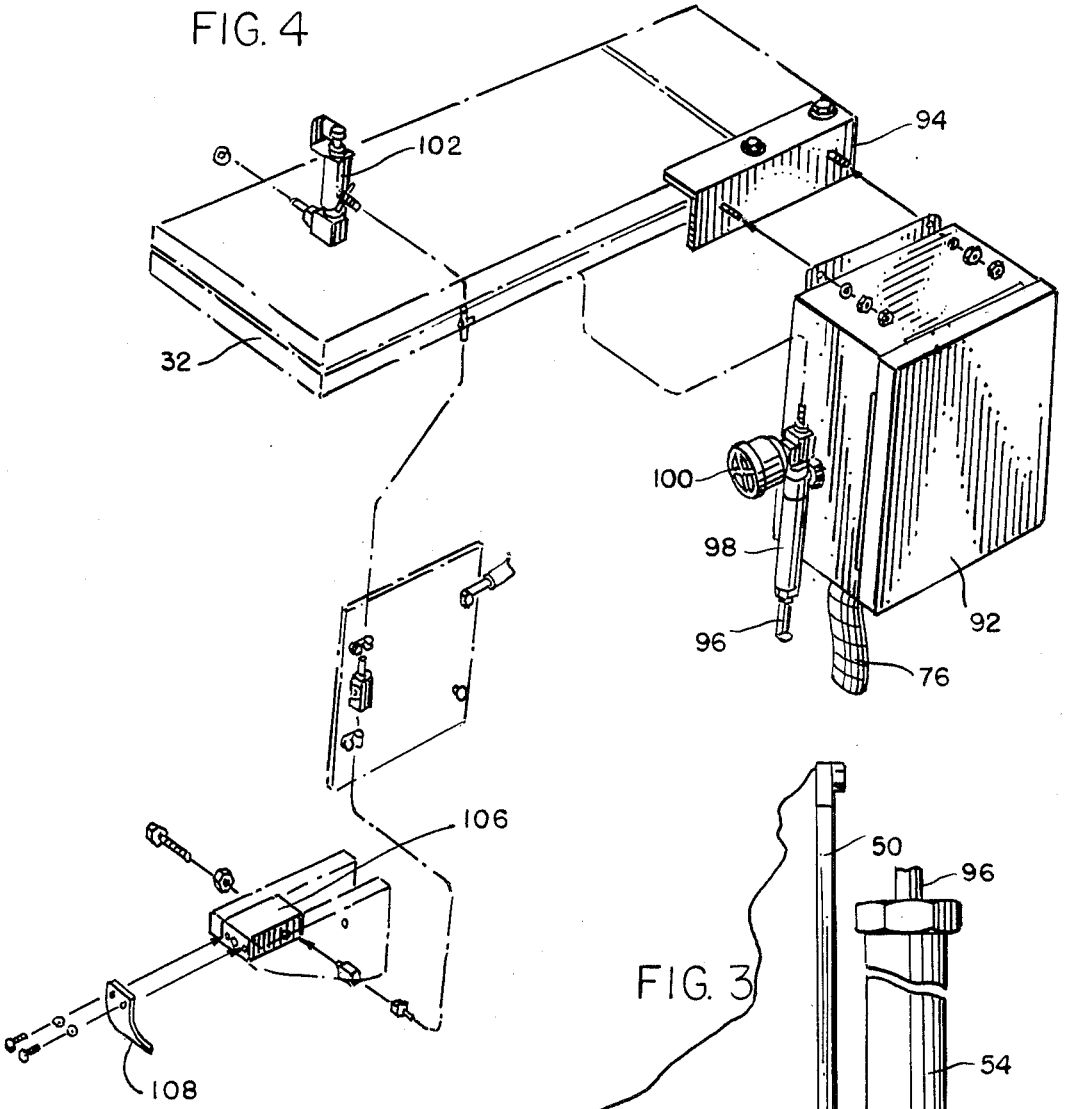
FIG. 4 is a partial perspective view of additional component parts associated with the improved cut-off mechanism of the invention.

FIG. 4 illustrates the control mechanism 31 associated with cylinder 54 and the heating element 72. The control mechanism is mounted on the head plate 32 of the clipper and includes a control box 92 attached to a bracket 94 affixed to the head plate 32. The control box 92 includes a heater power line 76 which connects to the element 72. Also associated with the control box 92 is a pneumatic control line 96 which supplies the pressure in the control box. A filter 98 and gauge 100 upstream from the line 96 connect with a pressurized air or pneumatic source. A pressure regulator 102 is also mounted on the head 32. Pneumatic pressure supplied through the line 96 is controlled through the control box 92 so that the dried air maintains a positive pressure in the control box through the conduit 76 and vented from the bottom of the cutting bar 58.

As also shown in FIG. 4, the pneumatic line leading from regulator 102 connects to a second regulator 104 which, in turn, connects with a block 106 that acts as a manifold to direct air into the region between plates 14 and 15. Thus, block 106 includes a series of openings directed downwardly as shown in FIG. 3 as well as a deflector plate 108 which acts to guide cooling air into the region between the plates 14 and 15 so that once plastic netting material 40 is severed by the heater bar 64, the forced ventilation will blow out the back of the device and away from the operator.

Referring now to the figures; the operation of the improved severing mechanism of the present invention will be set forth. As shown in FIG. 1, netting or packaging material 40 is first positioned in the throat openings 22, 23 for attachment of clips thereto. FIG. 2 illustrates how the clips 42 and 44 are attached to the netting material. Subsequently, a control signal through the control box 92 actuates the cylinder 54 to drive the rod 60 to its extended position so that the wedge-shaped and heated bar member 64 will move to the pad 86 of the cutting block 80. Since the member 64 is heated, and since the member 64 has a wedge-shaped cross section, it will tend to strain the netting material 40 as it impinges against that material 40. The temperature of the heated member 64 will cause the netting material to melt as it is strained. Subsequently, the control box 92 provides an output signal which causes the cylinder 54 to retract the rod 60 thereby withdrawing the heated member 64. Air flowing through the block 106 and guided by the deflector plate 108 will, during this operation, assist in solidifying the severed ends of the netting material. The clipped netting is then released from the throat opening. Subsequently the cycle is continuously repeated.

It is possible to vary the configuration and shape of the cutting block 80, pad 86, and cutting bar 58 to accommodate various types of materials. The sharpness of the cutting bar 58 as well as the amount of heat and energy provided to the bar as well as the cross sectional shape and length of the bar may all be varied depending upon the netting material or other material which is being cut or severed. An important advantage of the construction is elimination of plastic or material fragments associated with the cutting operation. Thus, while there has been set forth a preferred embodiment of the invention, it is understood that the invention is to be limited only by the following claims and their equivalents.

What is claimed is:

1. In a clip attachment apparatus of the type for attaching a U-shaped metal clip about gathered material, said material comprising meltable material, said apparatus including means for gathering the material prior to placement of the U-shaped clip about the material, a punch movable toward a fixed die and cooperative with the die for forming the U-shaped clip as a closure about the gathered material, with the clipped and gathered material extending laterally from the formed clip, the improvement comprising in combination:

a material severing mechanism affixed to the apparatus for severing gathered material extending laterally from a clip formed by the punch and die, said mechanism including:

(a) a generally fixed cutting block positioned adjacent one side of the die means and underlying the gathered material;

(b) a heated cutting bar;

(c) means for supporting the bar over and opposed to the cutting block;

(d) control means for transporting the cutting bar toward the block in the direction of the punch travel and against the gathered material to impinge, melt and sever gathered material or away from the block said cutting block including a surface opposed to the cutting bar and including air ejector means attached to the apparatus generally above the surface of the cutting block against which the heated cutting bar impinges; and (e) air supply means for providing air through the ejector means and onto material severed by the cutting bar to cool the severed material.

2. The improvement of claim 1 including a deflector plate supported by the apparatus, said plate positioned to direct air from the ejector means toward the severed material.

3. In a clip attachment apparatus of the type for attaching a U-shaped metal clip about gathered material, said material comprising meltable material, said apparatus including means for gathering the material prior to placement of the U-shaped clip about the material, a punch movable toward a fixed die and cooperative with the die for forming the U-shaped clip as a closure about the gathered material, with the clipped and gathered material extending laterally from the formed clip, the improvement comprising in combination:

a material severing mechanism affixed to the apparatus for severing gathered material extending laterally from a clip formed by the punch and die, said mechanism including:

(a) a generally fixed cutting block positioned adjacent one side of the die means and underlying the gathered material;

(b) a heated cutting bar, said cutting block including a surface opposed to the cutting bar;

(c) means for supporting the bar over and opposed to the cutting block;

(d) control means for transporting the cutting bar toward the block in the direction of punch travel and against the gathered material to impinge, melt and sever gathered material or away from the block; and (e) air ejector means attached to the apparatus generally above the surface of the cutting block against which the heated cutting bar impinges with air supply means for providing air through the ejector means and onto material severed by the cutting bar to cool the severed material.

4. The improvement of claim 3 including a deflector plate supported by the apparatus, said plate positioned to direct air from the ejector means toward the severed material.

* * * * *